US007015182B2

(12) United States Patent
Rindo et al.

(10) Patent No.: US 7,015,182 B2
(45) Date of Patent: Mar. 21, 2006

(54) DETERGENT COMPOSITION FOR CLEANING PRECISION PARTS

(75) Inventors: Katsuhiko Rindo, Wakayama (JP); Ryoichi Hashimoto, Wakayama (JP); Masataka Negishi, Wakayama (JP)

(73) Assignee: Kao Corporation, Tokyo (JP)

( * ) Notice: Subject to any disclaimer, the term of this patent is extended or adjusted under 35 U.S.C. 154(b) by 300 days.

(21) Appl. No.: 10/406,502

(22) Filed: Apr. 4, 2003

(65) Prior Publication Data

US 2003/0191037 A1 Oct. 9, 2003

(30) Foreign Application Priority Data

Apr. 5, 2002 (JP) ..... 2002-103597

(51) Int. Cl.
*C11D 7/50* (2006.01)

(52) U.S. Cl. ..... 510/175; 510/176; 510/200; 510/407; 510/505; 510/506

(58) Field of Classification Search ..... 510/175, 510/176, 365, 407, 417, 130, 506; 514/938
See application file for complete search history.

(56) References Cited

U.S. PATENT DOCUMENTS

| | | | | |
|---|---|---|---|---|
| 6,074,652 | A * | 6/2000 | Ishiwatari et al. | 424/401 |
| 6,221,816 | B1 * | 4/2001 | Kasuga et al. | 510/119 |

FOREIGN PATENT DOCUMENTS

| | | | |
|---|---|---|---|
| JP | 3-140486 | A | 6/1991 |
| JP | 4-34000 | A | 2/1992 |
| JP | 6-346094 | A | 12/1994 |
| JP | 6346092 | A | 12/1994 |
| JP | 9-255995 | A | 9/1997 |
| JP | 2000-8080 | A | 1/2000 |

* cited by examiner

*Primary Examiner*—Gregory Webb
(74) *Attorney, Agent, or Firm*—Birch, Stewart, Kolasch & Birch, LLP

(57) ABSTRACT

A detergent composition for cleaning a precision part, comprising an organic solvent, 5 to 30% by weight of a glyceryl ether having an alkyl group or alkenyl group having 4 to 12 carbon atoms, and 5% by weight or more of water. The detergent composition can be used for cleaning a precision part such as a metal part, an electronic part, a semiconductor part or a liquid crystal display panel.

31 Claims, No Drawings

DETERGENT COMPOSITION FOR CLEANING PRECISION PARTS

BACKGROUND OF THE INVENTION

1. Field of the Invention

The present invention relates to a detergent composition for cleaning a precision part. More specifically, the present invention relates to a water-containing detergent composition for cleaning a precision part such as a metal part, an electronic part, a semiconductor part or a liquid crystal display panel.

2. Discussion of the Related Art

Conventionally, wire connections of a printing substrate, a semiconductor package or the like have been carried out by solder connection via screen printing using cream solder. This cream solder comprises a eutectic solder component containing tin/lead, and a so-called flux component containing a resin, an active agent, an antioxidant, a thixotropic agent, and a solvent, which is used for the purposes of increasing screen printability and wiring reliability after connection. The flux component included herein has an important function of removing a metal oxide coating film at the connecting portion and the like. However, once the connection is completed, the flux component has a possibility that the reliability of the part is lowered thereafter, such as hygroscopicity, so that the flux component must be completely removed by cleaning the part.

In the removal of this flux component, a fluorocarbon-based solvent and a chlorine-based solvent have been used up until the 1990's in order to utilize its characteristics such as high detergency and fire retardancy. However, the detergent using a chlorine-based solvent or a fluorocarbon-based solvent has serious problems in safety, toxicity, environmental pollutions, and the like, so that these solvents were totally banned. Therefore, as a process to be used in place of these solvents, there have been numerously marketed a so-called water-containing flux detergent which takes into consideration of a risk such as ignition property by solubilizing water in a non-water-soluble component such as an organic solvent.

Recently, however, from the viewpoints of the development of finer wiring pitches and environmental protection needs, a composition of the flux has been modified in order to meet these needs in the cream solder component. Concretely, in order to increase the viscosity of the cream solder, the amount of the thixotropic agent in the composition of the flux tends to be increased. The reasons why the viscosity is to be increased are such that printing reliability in finer screen printing is improved and that edge rounding upon heating due to the modification of the non-lead-containing solder metal which has a higher melting point is prevented.

On the other hand, this flux component showing low solubility has been known to have high solubility to benzyl alcohol. Therefore, there has been disclosed a flux detergent using benzyl alcohol as a dissolution aid. For instance, Japanese Patent Gazette No. 2041987 discloses a non-water-based detergent composition comprising benzyl alcohol (or 2-phenetyl alcohol) as a main component, and a nonionic surfactant being added thereto; Japanese Patent Laid-Open No. Hei 4-34000 discloses a non-water-based detergent composition comprising benzyl alcohol as a main component; Japanese Patent Laid-Open Nos. Hei 6-346094 and Hei 9-255995 each discloses a water-containing detergent composition comprising 3-methoxy-3-methylbutanol as a main component, and benzyl alcohol and water being added thereto; Japanese Patent Laid-Open No. 2000-8080 discloses a water-containing detergent composition comprising benzyl alcohol as a main component, and a water-soluble glycol ether, a nonionic surfactant and water being added thereto. Also, as the detergent containing a glyceryl ether, Japanese Patent Laid-Open No. Hei 6-346092 discloses a detergent composition containing a glyceryl ether having a hydrocarbon group having 1 to 18 carbon atoms. Among them, the present inventors have carried out a cleaning test for a so-called water-containing flux detergent which has taken into consideration a risk such as ignition property. As a result, although the detergent shows high flux detergency against a generally used eutectic solder containing tin/lead, the detergent shows unsatisfactory detergency to flux in a lead-free solder or a solder for fine pitches in which the amount of the thixotropic agent such as N,N-ethylenebisstearamide is increased. Also, the detergent using a glyceryl ether as a dissolution aid also has unsatisfactory detergency to flux in a lead-free solder or the like as mentioned above.

In addition, as to the removal of the liquid crystal stains, the gap distance between the liquid crystal cells becomes even narrower with the development of thinner liquid crystal display panel, so that it has been becoming increasingly difficult to clean the liquid crystals existing in the gap. When the conventional detergent composition as mentioned above is used against the liquid crystal stains, the detergency is unsatisfactory for those liquid crystals existing in the gap, even though the detergency is excellent for the liquid crystals existing on the surface.

An object of the present invention is to provide a water-containing detergent composition for cleaning a precision part, which shows high detergency to flux when a lead-free solder and a solder for fine pitches is used as a solder in addition to the eutectic solder, and shows high detergency against stains mainly composed of organic substances existing on the surface of a metal part, an electronic part or a semiconductor part, or liquid crystal stains in a liquid crystal display panel, and the detergent composition having excellent safety.

These and other objects of the present invention will be apparent from the following description.

SUMMARY OF THE INVENTION

As mentioned above, the water-containing detergent so far published is for instance, a detergent in which water is solubilized in a non-water-soluble component such as benzyl alcohol for the purpose of taking into consideration the risk such as ignition property. For this purpose, a water-soluble component such as a water-soluble glycol ether or a nonionic surfactant is usually added. In this case, although the causation is not clear, the flux solubility obtained by the non-water-soluble component alone tends to be dramatically lowered by solubilizing water in the mixture. Further, the cleaning failure as described above is especially markedly exhibited in the lead-free solder and the solder for fine pitches in which the amount of the thixotropic agent is increased.

The present inventors have found for the first time that when a given amount of water is solubilized in a non-water-soluble component containing a given amount of a glyceryl ether having an alkyl group or alkenyl group having a specified structure, the flux solubility is not lowered, and excellent detergency against liquid crystal stains is exhibited.

According to the present invention, there is provided a detergent composition for cleaning a precision part, comprising an organic solvent, 5 to 30% by weight of a glyceryl ether having an alkyl group or alkenyl group having 4 to 12 carbon atoms, and 5% by weight or more of water.

DETAILED DESCRIPTION OF THE INVENTION

The detergent composition for cleaning a precision part of the present invention (hereinafter simply referred to as "detergent composition"), as mentioned above, comprises an organic solvent, 5 to 30% by weight of a glyceryl ether having an alkyl group or alkenyl group having 4 to 12 carbon atoms, and 5% by weight or more of water. In the present invention, one of the great features resides in that the three components are used together at a specified ratio. By using the detergent composition having the composition as described above, the flux can be safely cleaned with easy handling in a lead-free solder or a solder for fine pitches in which the amount of thixotropic agent is increased as a solder in addition to the eutectic solder. Further, so-called "liquid crystal stains" which are liquid crystals existing in the gap of the liquid crystal cell can be cleaned. Especially, there is exhibited an excellent effect that those liquid crystal stains existing in the liquid crystal cells between the narrow gap distance which have been difficult to be cleaned with the conventional detergents can be cleaned.

The organic solvent usable in the present invention is preferably an organic solvent having solubility of N,N-ethylenebisstearamide of 0.3% by weight or more at 70° C., from the viewpoint of detergency to flux. Here, the "organic solvent having solubility of N,N-ethylenebisstearamide of 0.3% by weight or more at 70° C." refers to an organic solvent in which N,N-ethylenebisstearamide can be dissolved in an amount of 0.3 parts by weight or more, in 100 part by weight of the organic solvent kept at 70° C. This solubility can be obtained as follows.

N,N-Ethylenebisstearamide and the organic solvent are accurately weighed in a screw tube, so that the concentration of N,N-ethylenebisstearamide is, for instance, 0.1 parts by weight, 0.2 parts by weight, and 0.3 parts by weight, based on 100 parts by weight of the organic solvent. Next, a mixture of N,N-ethylenebisstearamide and the organic solvent is heated to 70° C. The dissolution state of the mixture is confirmed by judging whether or not the resulting solution becomes transparent and soluble. Here, if the mixture becomes transparent and soluble with 0.2 parts by weight of N,N-ethylenebisstearamide but becomes white turbid with 0.3 parts by weight of N,N-ethylenebisstearamide, and this is defined as 0.2% by weight solubility. By repeating the above procedures, the obtained solubility can have increased precision.

The organic solvent includes linear alcohols having 4 to 16 carbon atoms such as butanol (0.5% by weight or more), hexanol (0.5% by weight or more), octanol (0.5% by weight or more), lauryl alcohol (0.5% by weight or more) and stearyl alcohol (0.5% by weight or more); branched alcohols having 10 to 16 carbon atoms such as 4-decanol (0.5% by weight or more), 2-heptylnonanol (0.5% by weight or more), and 7-methyl-2-(3-methylbutyl)-1-octanol (0.5% by weight or more); unsaturated alcohols such as benzyl alcohol (0.3% by weight or more), 1-hexen-3-ol (1% by weight or more), 2-hexen-3-ol (0.75% by weight or more), 1-octen-3-ol (1% by weight or more), linalool (0.5% by weight or more), and ω-undecyl alcohol (0.5% by weight or more); dipropylene glycol monoalkyl ethers such as dipropylene glycol monopropyl ether (0.3% by weight or more) and dipropylene glycol monobutyl ether (0.3% by weight or more); and fatty acids such as acetic acid (0.5% by weight or more), propionic acid (2% by weight or more), hexanoic acid (1.75% by weight or more), and 2-ethylhexanoic acid (0.75% by weight or more) (Numerical figures inside the above parentheses show solubility of the organic solvent). Among them, benzyl alcohol, dipropylene glycol monopropyl ether and dipropylene glycol monobutyl ether are preferable.

Also, the hydrocarbons having 10 to 18 carbon atoms are preferable, from the viewpoint of having excellent detergency against liquid crystal stains. The hydrocarbons having 10 to 18 carbon atoms include, for instance, linear or branched, saturated or unsaturated hydrocarbon-based solvents such as decane, dodecane, tetradecane, hexadecane, octadecane, decene, dodecene, tetradecene, hexadecene, and octadecene; aromatic hydrocarbon-based solvents such as alkylbenzenes such as nonylbenzene and dodecylbenzene, and naphthalene compounds such as methylnaphthalene and dimethylnaphthalene; alicyclic hydrocarbon-based solvents such as cyclocyclic compounds such as cyclodecane and cyclododecene; and the like. Among them, linear or branched, saturated or unsaturated hydrocarbons having 12 to 18 carbon atoms are preferable, and olefinic hydrocarbons are especially preferable.

These organic solvents can be used alone or in admixture of two or more kinds.

The glyceryl ether having an alkyl group or alkenyl group having 4 to 12 carbon atoms (hereinafter simply referred to as "glyceryl ether") usable in the present invention may be those having an alkyl group or alkenyl group having 4 to 12 carbon atoms, preferably those having an alkyl group having 4 to 12 carbon atoms such as n-butyl group, isobutyl group, n-hexyl group, isohexyl group, n-heptyl group, n-octyl group, 2-ethylhexyl group, n-nonyl group, and n-decyl group, especially preferably those having one or two alkyl groups each having 6 to 10 carbon atoms, more preferably 6 to 8 carbon atoms, especially one of the alkyl group, from the viewpoints of not reducing its detergency, and maintaining homogeneous and transparent properties of the manufactured detergent composition in an operable temperature range. Further, the glyceryl ether having an alkyl group or alkenyl group having 4 to 12 carbon atoms usable in the present invention may be a monoalkyl diglyceryl ether or a monoalkyl polyglyceryl ether in which two or more, preferably two to three, glyceryl groups are bonded via ether bonds. Especially, a monoalkyl glyceryl ether and a monoalkyl diglyceryl ether are preferable, from the viewpoint of excellent detergency against liquid crystal stains. These glyceryl ethers can be used alone or in admixture of two or more kinds. In the present invention, the dispersibility of the organic solvent with water can be stabilized by using the glyceryl ether, so that there are advantages such that more excellent detergency against flux and/or liquid crystal stains is obtained.

Water usable in the present invention is not particularly limited. Water includes ion-exchanged water, pure water, and the like.

In the detergent composition of the present invention, the content of the organic solvent is preferably from 1 to 90% by weight, more preferably from 50 to 90% by weight, still more preferably from 60 to 90% by weight, especially preferably from 65 to 85% by weight, from the viewpoint of obtaining excellent detergency to flux. Also, the content of the glyceryl ether is 5 to 30% by weight, and the content is preferably from 10 to 30% by weight, more preferably from 10 to 25% by weight, still more preferably from 10 to 20% by weight, from the viewpoints of obtaining excellent flux solubility and excellent detergency against organic stains. In addition, the content of water is 5% by weight or more, and the content is preferably from 5 to 30% by weight, more preferably from 5 to 20% by weight, especially preferably from 5 to 15% by weight, from the viewpoints of not causing ignition of the detergent composition and maintaining flux solubility. Among them, when the detergent composition of the present invention is used for cleaning flux stains in a lead-free solder or fine pitch solder containing N,N-ethylenebisstearamide in a large amount as a thixotropic agent, it is preferable that the content of the organic solvent is from 65 to 85% by weight, that the content of the glyceryl ether is from 10 to 20% by weight, and that the content of water is 5 to 15% by weight.

In addition, the detergent composition of the present invention has the following Composition 1 or Composition 2, from the viewpoint of obtaining excellent detergency against liquid crystal stains.

In Composition 1, the content of the organic solvent is preferably from 5 to 40% by weight, more preferably from 10 to 20% by weight. Also, the content of the glyceryl ether is from 5 to 30% by weight, and the content is preferably from 10 to 30% by weight, more preferably from 10 to 25% by weight, especially preferably from 10 to 20% by weight, from the viewpoint of obtaining excellent detergency against liquid crystal stains. In addition, the content of water is 5% by weight or more, and the content is preferably from 40 to 90% by weight, more preferably from 60 to 80% by weight, from the viewpoint of not causing ignition of the detergent composition and from the viewpoint of maintaining detergency against liquid crystal stains. Among them, the preferred combinations of the above-mentioned three components which have excellent detergency against liquid crystal stains are such that the content of the organic solvent is from 5 to 40% by weight, that the content of the glyceryl ether is from 5 to 30% by weight, and that the content of water is from 40 to 90% by weight. More preferred combinations are such that the content of the organic solvent is from 10 to 20% by weight, that the content of the glyceryl ether is from 10 to 20% by weight, and that the content of water is from 60 to 80% by weight.

In Composition 2, the content of the organic solvent is preferably from 50 to 90% by weight, more preferably from 60 to 80% by weight. Also, the content of the glyceryl ether is from 5 to 30% by weight, and the content is preferably from 10 to 30% by weight, especially preferably from 10 to 25% by weight, from the viewpoint of obtaining excellent detergency against liquid crystal stains. In addition, the content of water is 5% by weight or more, and the content is preferably from 5 to 40% by weight, especially preferably from 5 to 30% by weight, from the viewpoint of maintaining detergency against liquid crystal stains. Among them, the preferred combinations of the above-mentioned three components which have excellent detergency against liquid crystal stains are such that the content of the organic solvent is from 50 to 90% by weight, that the content of the glyceryl ether is from 5 to 30% by weight, and that the content of water is from 5 to 40% by weight. More preferred combinations are such that the content of the organic solvent is from 60 to 80% by weight, that the content of the glyceryl ether is from 10 to 25% by weight, and that the content of water is from 5 to 30% by weight.

In addition, when the detergent composition of the present invention is used for detergency to flux, the detergent composition may contain a flux saponification agent and a defoaming agent. As the flux saponification agent, there can be used an amine such as an alkylamine or an alkanolamine. Furthermore, as the defoaming agent, there can be used a silicone-based defoaming agent, a mineral oil-based defoaming agent, a glycol-based defoaming agent, and the like.

The content of the flux saponification agent and the defoaming agent in the detergent composition is preferably from 0.1 to 5% by weight, more preferably from 0.5 to 3% by weight.

When the detergent composition of the present invention is used for cleaning flux, the detergent composition having solubility of N,N-ethylenebisstearamide at 70° C. of 0.15% by weight or more is preferable, more preferably 0.2% by weight or more. Here, the "solubility of N,N-ethylenebisstearamide at 70° C. of 0.15% by weight or more" refers to a property that N,N-ethylenebisstearamide can dissolve in an amount of 0.15 parts by weight or more, in 100 parts by weight of the detergent composition kept at 70° C. Also, the solubility of N,N-ethylenebisstearamide in the detergent composition can be obtained in the same manner as the method for obtaining solubility in the case of the above-mentioned by using the detergent composition, except that the detergent composition is used in place of the organic solvent.

Among them, when the detergent composition of the present invention is used for cleaning liquid crystal stains, it is preferable to add a glycol ether compound to the detergent composition, from the viewpoint of lowering the viscosity of the cleaning solution, thereby improving the detergency of the liquid crystals existing in the gap between liquid crystal cells. Concrete examples of the glycol ether compound include ethylene glycol monoalkyl(1 to 12 carbon atoms) ethers, such as ethylene glycol monomethyl ether, ethylene glycol monoethyl ether, ethylene glycol monopropyl ether, ethylene glycol monobutyl ether, ethylene glycol monohexyl ether, and ethylene glycol mono2-ethylhexyl ether; diethylene glycol monoalkyl(1 to 12 carbon atoms) ethers, such as diethylene glycol monomethyl ether, diethylene glycol monoethyl ether, diethylene glycol monobutyl ether, diethylene glycol monohexyl ether, and diethylene glycol mono2-ethylhexyl ether; propylene glycol or dipropylene glycol monoalkyl(1 to 12 carbon atoms) ethers, such as benzyl glycol, benzyl diglycol, phenyl glycol, propylene glycol monopropyl ether, dipropylene glycol monopropyl ether, propylene glycol monobutyl ether, and dipropylene glycol monobutyl ether; and the like. Among them, diethylene glycol monohexyl ether and dipropylene glycol monobutyl ether are preferable, and diethylene glycol monohexyl ether is especially preferable.

The content of the glycol ether in the detergent composition of the present invention is preferably from 25 to 100 parts by weight, more preferably from 40 to 90 parts by weight, especially preferably from 50 to 80 parts by weight, based on 100 parts by weight of a total amount of the organic solvent, the glyceryl ether and water, from the viewpoints of lowering the viscosity of the detergent solution, increasing the penetrability into the gap of the liquid crystal cell and increasing the detergency of the liquid crystals.

The detergent composition of the present invention having the above-mentioned constitution can be prepared by, for instance, mixing the above-mentioned organic solvent and the above-mentioned glyceryl ether with stirring, mixing other optional components as occasion demands, and finally adding water thereto.

When the detergent composition of the present invention is used to carry out cleaning of a precision part, for instance, a precision part having flux stains, the detergent composition can be used for all sorts of cleaning procedures, including immersion cleaning process, stirring cleaning process, ultrasonic cleaning process, spray-type cleaning process, brush cleaning process and the like. In addition, when the detergent composition is used for cleaning a precision part having liquid crystal stains, the detergent composition can be used for all sorts of cleaning procedures, including immersion cleaning process, stirring cleaning process, ultrasonic cleaning process, brush cleaning process and the like.

The flux to be cleaned by the detergent composition of the present invention is not particularly limited, as long as the flux is generated in wire connections of a printing substrate, a semiconductor package or the like. The detergent composition of the present invention especially shows high detergency against soldering flux. The solder includes eutectic solder composed of tin and lead, and a lead-free solder or a solder for fine pitches, in which an amount of a thixotropic agent is increased.

In addition, the detergent composition of the present invention shows a high detergency against stains mainly composed of organic substances and the stains on liquid crystals such as a liquid crystal panel, in which the stains exist on a surface of, for instance, a metal part, an electronic part, a semiconductor part or the like. Especially, as to the liquid crystal panel, the detergent composition of the present invention shows a high detergency against liquid crystal stains of liquid crystal cells having a narrow gap distance of from 3 to 6 $\mu$m in addition to those of conventionally employed liquid crystal cells having a gap distance of from 7 to 10 $\mu$m.

As described above, by using the detergent composition of the present invention for cleaning a precision part, wire of a printing substrate, a semiconductor package or the like and a liquid crystal display panel can be safely prepared with easy handling.

EXAMPLES

<Preparation 1 of Test Substrate>

A cream solder was screen-printed on a glass epoxy substrate on which cupper patterns had been printed. The glass epoxy substrate was heated at 250° C. for 30 seconds to give a test substrate.

Examples 1 to 8 and Comparative Examples 1 to 3

Each component was added and mixed so as to give the composition shown in Table 1, to give each of the detergent compositions of Examples 1 to 8 and Comparative Examples 1 to 3. Next, each detergent composition was placed in a cleaning vessel, and the above-mentioned test substrate was immersed in the detergent composition at 60° C. for 5 minutes. Thereafter, the test substrate was rinsed with ion-exchanged water at 60° C. for 1 minute. Subsequently, the rinsed substrate was dried at 80° C. for 20 minutes. The surface of the test substrate was visually observed, and detergency to flux was evaluated on the basis of the following evaluation criteria. The results are shown in Table 2.

| [Evaluation Criteria for Detergency to Flux] | |
|---|---|
| A: | Excellently cleaned (no remaining adhesion of the flux residue) |
| B: | Slightly poorly cleaned (slight remaining adhesion) |
| C: | Poorly cleaned (much remaining adhesion being recognized) |
| D: | Not cleaned at all |

Here, the cream solders using the cleaning test are shown below. Inside quotation marks show trade names.

Lead-free solder "M312-221BM5-42-11" (manufactured by Senju Kinzoku)

Lead-free solder "Ecosolder M705" (manufactured by Senju Kinzoku)

Lead-free solder "Solder Paste TLF-204-19A" (manufactured by Tamura Giken)

Solder for fine-pitch "OZ63-331F4-9.5" (manufactured by Senju Kinzoku)

Tin-lead eutectic solder "RX363-227DDO" (manufactured by Nihon Handa)

High-melting point solder "RX305-92MYO" (manufactured by Nihon Handa)

TABLE 1

| | Ex. No. | | | | | | | | Comp. Ex. No. | | |
|---|---|---|---|---|---|---|---|---|---|---|---|
| | 1 | 2 | 3 | 4 | 5 | 6 | 7 | 8 | 1 | 2 | 3 |
| | Composition of Detergent Composition (% by weight) | | | | | | | | | | |
| Organic Solvent | | | | | | | | | | | |
| Benzyl Alcohol (0.3% by wt or more)*) | 75.0 | 75.0 | 75.0 | 80.0 | 73.2 | | | 36.6 | 75.0 | | |
| Dipropylene Glycol Monopropyl Ether (0.3% by wt or more) | | | | | | 73.2 | | | | | |
| Dipropylene Glycol Monobutyl Ether (0.3% by wt or more) | | | | | | | 73.2 | 36.6 | | | |
| Butyl Diglycol (0.1% by wt or less) | | | | | | | | | | 44.5 | 26.3 |
| Hexyl Diglycol (0.1% by wt or less) | | | | | | | | | 10.0 | 44.5 | |
| Glyceryl Ether | | | | | | | | | | | |
| 2-Ethylhexyl Glyceryl Ether | 15.0 | | | 10.0 | 14.7 | 14.7 | 14.7 | 14.7 | | | |
| Hexyl Glyceryl Ether | | 15.0 | | | | | | | | | |
| Octyl Glyceryl Ether | | | 15.0 | | | | | | | | |
| Water | 10.0 | 10.0 | 10.0 | 10.0 | 10.0 | 10.0 | 10.0 | 10.0 | 10.0 | 10.0 | 70.9 |
| Surfactant | | | | | | | | | | | |
| Polyoxyalkylene Monophenyl Ether (HLB: ca. 12) | | | | | | | | | 5.0 | | |
| Polyoxyalkylene Monoalkyl Ether (HLB: ca. 10) | | | | | | | | | | | 0.7 |

TABLE 1-continued

| | Ex. No. | | | | | | | | Comp. Ex. No. | | |
|---|---|---|---|---|---|---|---|---|---|---|---|
| | 1 | 2 | 3 | 4 | 5 | 6 | 7 | 8 | 1 | 2 | 3 |
| Additive | | | | | | | | | | | |
| Flux Saponification Agent (Diethanolamine) | | | | | 1.0 | 1.0 | 1.0 | 1.0 | | 0.9 | 2.1 |
| Defoaming Agent (Silicone Defoaming Agent) | | | | | 1.1 | 1.1 | 1.1 | 1.1 | | 0.1 | |
| Total | 100.0 | 100.0 | 100.0 | 100.0 | 100.0 | 100.0 | 100.0 | 100.0 | 100.0 | 100.0 | 100.0 |
| Solubility of N,N-Ethylenebisstearamide in Detergent Composition at 70° C. (% by wt.) | 0.25 | 0.22 | 0.20 | 0.28 | 0.23 | 0.20 | 0.16 | 0.20 | 0.08 | 0.05 | 0.05 |

Note
*)Solubility of ethylenebisstearamide to the organic solvent at 70° C.

TABLE 2

| | Ex. No. | | | | | | | | Comp. Ex. No. | | |
|---|---|---|---|---|---|---|---|---|---|---|---|
| | 1 | 2 | 3 | 4 | 5 | 6 | 7 | 8 | 1 | 2 | 3 |
| Lead-Free Solder | | | | | | | | | | | |
| M312-221BM5-42-11 | A | A | A | A | A | A | A | A | C | C | C |
| Solder Paste TLF-204-19A | A | A | A | A | A | A | A | A | D | B | D |
| Ecosolder M705-221BM-5-42-11 | A | A | A | A | A | A | A | A | D | B | D |
| Solder for Fine Pitch | | | | | | | | | | | |
| OZ63-331F4-9.5 | A | A | A | A | A | A | A | A | C | B | C |
| Tin-Lead Eutectic Solder | | | | | | | | | | | |
| RX363-227DDO | A | A | A | A | A | A | A | A | B | A | C |
| High-Melting Point Solder | | | | | | | | | | | |
| RX305-92MYO | A | A | A | A | A | A | A | A | D | B | D |

It can be seen from the results of Table 2 that since the detergent compositions of Examples 1 to 8 show high solubility to N,N-ethylenebisstearamide, the detergent compositions have excellent detergency to flux against any of the lead-free solder, the solder for fine pitch, the tin-lead eutectic solder and the high-melting point solder, as compared to those of any of the detergent compositions of Comparative Examples 1 to 3. In addition, since all of the detergent compositions of Examples 1 to 8 contain water, there would be no risk of ignition at a cleaning treatment temperature of 60° C. or so, so that the detergent compositions have excellent safety.

<Preparation 2 of Test Substrate>

TFT liquid crystals were sealed into a gap between liquid crystal cells (distance between the gap: 5 μm), and the cells were allowed to stand at room temperature for 30 minutes, to give a test substrate.

Examples 9 to 12 and Comparative Examples 4 to 6

Each component was added and mixed so as to give the composition shown in Table 3, to give each of the detergent compositions of Examples 9 to 12 and Comparative Examples 4 to 6. The test substrate was subjected to ultrasonic cleaning for 5 minutes in each of detergent compositions prepared at 30° C. Thereafter, the test substrate was rinsed for 3 minutes in each of four pure water tanks (40° C.). Subsequently, the rinsed substrate was dried at 90° C. for 30 minutes with a hot air dryer, to be an observation sample.

[Evaluation Method for Detergency]

The liquid crystals remaining in the gap between the liquid crystal cells after cleaning, and a mixture of the liquid crystals not sufficiently discharged during rinsing and the detergent composition were observed by a polarization microscope (magnification: 25 times), and the detergency of the liquid crystal panel was evaluated.

The evaluation for the detergency was shown by a value calculated by dividing an area resultant of subtraction of the portions at which the liquid crystals and a mixture of the liquid crystals and the detergent remained from an entire area of the observed gap by the entire area of the observed gap. The evaluation criteria were as defined as follows:

| Evaluation Criteria for Detergency: | |
|---|---|
| ◎: | 90 to 100% |
| ○: | 80% to less than 90% |
| Δ: | 40% to less than 80% |
| X: | less than 40% |

[Dissolution Rate of Liquid Crystals]

A liquid crystal cell test substrate in which TFT liquid crystals were filled prepared in the same manner as described above was immersed in a detergent composition at 30° C. for 5 minutes, and a distance at which the detergent composition penetrated in the gap was determined by an optical microscopic observation with the lens having a magnification of 25 times. The liquid crystal dissolution rate was defined as a value obtained by dividing the obtained penetration distance by time.

TABLE 3

| | Ex. No. | | | | Comp. Ex. No. | | |
|---|---|---|---|---|---|---|---|
| | 9 | 10 | 11 | 12 | 4 | 5 | 6 |
| Composition (Parts by Weight) | | | | | | | |
| Organic Solvent | | | | | | | |
| Tetradecene | 70 | 70 | | 13 | 100 | 70 | 70 |
| Dodecene | | | 70 | | | | |
| Glyceryl Ether | | | | | | | |
| 2-Ethylhexyl Glyceryl Ether | 25 | | | | | 30 | |
| 2-Ethylhexyl Diglyceryl Ether | | 25 | 25 | 20 | | | |
| Polyoxyethylene Alkyl Ether (C12–14, Secondary Alcohol) | | | | | | | 20 |
| Diethylene Glycol Monohexyl Ether | | | | 40* | | | |
| Water | 5 | 5 | 5 | 67 | | | 5 |
| Liquid Crystal Dissolution Rate (μm/minute) | 9.0 | 9.0 | 9.0 | 10.0 | 11.0 | 6.0 | 7.0 |
| Detergency of Liquid Crystals | ○ | ○ | ○ | ◎ | X | Δ | Δ |

Note

*parts by weight based on 100 parts by weight of a total amount of an organic solvent, glyceryl ether and water.

It can be seen from the results of Table 3 that since the rinsing ability of the detergent compositions is excellent with maintaining a high liquid crystal dissolution rate in Examples 9 to 12, the detergent compositions are well penetrated in the narrow gap between the liquid crystal cells, so that the detergent compositions do not remain in the gap, whereby consequently having excellent detergency.

On the other hand, in the detergent composition where an organic solvent is used alone (Comparative Example 4), it can be seen that the detergency of the detergent composition itself is worsened because exchange with water is worsened in the rinsing process in the cleaning test, even though the liquid crystal dissolution rate in the gaps became high.

Also, in the detergent composition where no water is contained (Comparative Example 5) or no glyceryl ether is contained (Comparative Example 6), the detergency of the liquid crystal panel is worsened because the liquid crystal dissolution rate is lowered in any of the detergent compositions.

Since the detergent composition for a precision part of the present invention can be handled safely and exhibits high detergency to flux even when the detergent composition is used for cleaning flux on a lead-free solder or a solder for fine pitch in addition to that on eutectic solder, printing substrates and wiring such as semiconductor package can be easily handled and safely prepared. In addition, when the detergent composition is used for cleaning liquid crystals, the detergent composition is penetrated well into a narrow gap between the liquid crystals, thereby showing high detergency. Therefore, precision parts such as electronic parts, semiconductor parts and liquid crystal display panels can be safely produced in high quality.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A detergent composition for cleaning a precision part, comprising:

an organic solvent present in an amount of from 50 to 90% by weight;

5 to 30% by weight of a glyceryl ether having an alkyl group or alkenyl group having 4 to 12 carbon atoms; and 5% by weight or more of water.

2. The detergent composition according to claim 1, which is usable for cleaning a precision part having flux stains, wherein the water is present in an amount of from 5 to 30% by weight.

3. The detergent composition according to any one of claim 1 or 2, wherein the organic solvent comprises an organic solvent in which N,N-ethylenebisstearamide is soluble in an amount of 0.3% by weight or more at 70° C.

4. The detergent composition according to any one of claim 1 or 2, wherein the organic solvent is at least one compound selected from the group consisting of benzyl alcohol, dipropylene glycol monopropyl ether and dipropylene glycol monobutyl ether.

5. The detergent composition according to claim 1, which is usable for cleaning a precision part having liquid crystal stains, wherein said water is present in an amount of from 5 to 40% by weight.

6. The detergent composition according to claim 1, further comprising a glycol ether compound.

7. The detergent composition according to claim 1, wherein the organic solvent is a hydrocarbon having 10 to 18 carbon atoms.

8. The detergent composition according to claim 7, wherein said organic solvent is selected from the group consisting of linear or branched hydrocarbon-based solvents, saturated or unsaturated hydrocarbon-based solvents, aromatic hydrocarbon-based solvents, alicyclic hydrocarbon-based solvents, and mixtures thereof.

9. The detergent composition according to claim 8, wherein said solvent is selected from the group consisting of decane, dodecane, tetradecane, hexadecane, octadecane, decene, dodecene, tetradecene, hexadecane, octadecene, nonylbenzene, dodecylbenzene, methylnaphthalene, dimethylnaphthalene, cyclodecane, cyclododecane, and mixtures thereof.

10. The detergent composition according to claim 1, wherein said organic solvent is selected from the group consisting of linear alcohols having 4 to 16 carbon atoms, branched alcohols having 10 to 16 carbon atoms, unsaturated alcohols, dipropylene glycol monoalkyl ethers, and fatty acids.

11. The detergent composition according to claim 6, wherein said glycol ether is selected from the group consisting of ethylene glycol mono $C_{1-12}$ alkyl ethers, diethylene glycol mono $C_{1-12}$ alkyl ethers, propylene glycol mono $C_{1-12}$ alkyl ethers, and dipropylene glycol mono $C_{1-12}$ alkyl ethers.

12. The detergent composition according to claim 1, wherein said organic solvent is present in an amount of from 60 to 90% by weight.

13. The detergent composition according to claim 12, wherein said organic solvent is present in an amount of from 65 to 85% by weight.

14. The detergent composition according to claim 1, wherein said glyceryl ether is present in an amount of from 10 to 20% by weight, and said water is present in an amount of from 5 to 15% by weight.

15. A detergent composition for cleaning a precision part, comprising:

at least one organic solvent compound selected from the group consisting of linear or branched hydrocarbon-based solvents, saturated or unsaturated hydrocarbon-based solvents, aromatic hydrocarbon-based solvents, alicyclic hydrocarbon-based solvents, and mixtures thereof;

5 to 30% by weight of a glyceryl ether having an alkyl group or alkenyl group having 4 to 12 carbon atoms; and 5% by weight or more of water.

16. The detergent composition according to claim 15, wherein the organic solvent is present in an amount of from 1 to 90% by weight.

17. The detergent composition according to claim 15, which is usable for cleaning a precision part having flux stains, wherein the organic solvent is present in an amount of from 50 to 90% by weight, and water is present in an amount of from 5 to 30% by weight.

18. The detergent composition according to claim 15, which is usable for cleaning a precision part having liquid crystal stains, wherein each amount of the organic solvent and water is either:

(i) the organic solvent is present in an amount of from 5 to 40% by weight, and said water is present in an amount of from 40 to 90% by weight; or (ii) the organic solvent is present in an amount of from 50 to 90% by weight, and said water is present in an amount of from 5 to 40% by weight.

19. The detergent composition according to claim 15, wherein a glycol ether compound is present.

20. The detergent composition according to claim 15, wherein said organic solvent is selected from the group consisting of benzyl alcohol, dipropylene glycol monopropyl ether and dipropylene glycol monobutyl ether.

21. The detergent composition according to claim 15, wherein said solvent is selected from the group consisting of decane, dodecane, tetradecane, hexadecane, octadecane, decene, dodecene, tetradecene, hexadecane, octadecene, nonylbenzene, dodecylbenzene, methylnaphthalene, dimethylnaphthalene, cyclodecane, cyclododecane, and mixtures thereof.

22. The detergent composition according to claim 10, wherein said ether is selected from the group consisting of ethylene glycol mono $C_{1-12}$ alkyl ethers, diethylene glycol mono $C_{1-12}$ alkyl ethers, propylene glycol mono $C_{1-12}$ alkyl ethers, and dipropylene glycol mono $C_{1-12}$ alkyl ethers.

23. The detergent composition according to claim 15, wherein said organic solvent is present in an amount of from 60 to 90% by weight.

24. The detergent composition according to claim 23, wherein said organic solvent is present in an amount of from 65 to 85% by weight.

25. The detergent composition according to claim 15, wherein said glyceryl ether is present in an amount of from 10 to 20% by weight, and said water is present in an amount of from 5 to 15% by weight.

26. A process for cleaning a precision part, comprising contacting said precision part with a detergent composition for said precision part comprising:

an organic solvent present in an amount from 50 to 90% by weight;

5 to 30% by weight of a glyceryl ether having an alkyl group or alkenyl group having 4 to 12 carbon atoms; and 5% by weight or more of water.

27. The process according to claim 26, wherein and water is present in an amount of from 5 to 40% by weight.

28. The process according to any one of claims 26 to 27, wherein the organic solvent comprises an organic solvent in which N,N-ethylenebisstearamide is soluble in an amount of 0.3% by weight or more at 70° C.

29. The process according to any one of claims 26 to 27, wherein the organic solvent is at least one compound selected from the group consisting of benzyl alcohol, dipropylene glycol monopropyl ether and dipropylene glycol monobutyl ether.

30. The process according to claim 26, wherein said composition further comprises a glycol ether compound.

31. The process according to claim 26, wherein the organic solvent is a hydrocarbon having 10 to 18 carbon atoms.

* * * * *